United States Patent [19]

Gaunt et al.

[11] Patent Number: 4,711,374

[45] Date of Patent: Dec. 8, 1987

[54] LOW-COST POST-MIX BEVERAGE DISPENSER AND SYRUP SUPPLY SYSTEM THEREFOR

[75] Inventors: Loraine E. Gaunt, Marietta; Samuel C. Crosby, Decatur; William J. Saunders, Stone Mountain; Robert D. Bruffey, Jr., Lilburn, all of Ga.

[73] Assignee: The Coca-Cola Company, Atlanta, Ga.

[21] Appl. No.: 907,821

[22] Filed: Sep. 16, 1986

Related U.S. Application Data

[62] Division of Ser. No. 775,833, Sep. 13, 1985, Pat. No. 4,635,824.

[51] Int. Cl.[4] ..... B67D 5/56; E03B 3/00

[52] U.S. Cl. ..... 222/129.1; 222/145; 222/505; 222/509; 137/607

[58] Field of Search ..... 222/129.1, 145, 129.2, 222/129.3, 129.4, 505, 509; 137/607, 637

[56] References Cited

U.S. PATENT DOCUMENTS

| | | | |
|---|---|---|---|
| 2,573,888 | 11/1951 | Benjamin et al. | 137/607 X |
| 3,168,967 | 2/1965 | Giampa | 222/129.1 |
| 3,192,952 | 7/1965 | Botnick | 137/637 X |
| 3,902,636 | 9/1975 | Zilk | 137/607 X |
| 4,497,421 | 2/1985 | Schilling | 137/607 X |
| 4,549,675 | 10/1985 | Austin | 137/607 X |

*Primary Examiner*—Joseph J. Rolla
*Assistant Examiner*—Gregory L. Huson
*Attorney, Agent, or Firm*—Birch, Stewart, Kolasch & Birch

[57] ABSTRACT

A post-mix beverage dispensing system of a small size and capacity includes a minimal number of cabinet-mounted dispensing valve assemblies to be used in combination with a larger number of syrup valve adaptor assemblies. The adaptor assemblies are attached to removable syrup containers and are removable from the cabinet-mounted valve assemblies with the containers. The adaptor assemblies include syrup outlet tubes with flow-rate orifice plates matched to predetermined brix values of syrup flavors. A valve actuation assembly is provided which may selectively dispense either soda water alone or a carbonated post-mix beverage.

1 Claim, 9 Drawing Figures

LOW-COST POST-MIX BEVERAGE DISPENSER AND SYRUP SUPPLY SYSTEM THEREFOR

This application is a divisional of copending application Ser. No. 775,833, filed on Sept. 13, 1985 and now U.S. Pat. No. 4,635,824.

BACKGROUND OF THE INVENTION

The present invention relates to a post-mix beverage dispensing system of a relatively small size and capacity suitable for use in small business locations or in the home. More specifically, the present invention relates to an improved syrup supply system and valve assembly for a post-mix beverage dispenser.

In small capacity beverage dispensers known heretofore, such as the one described in U.S. Pat. No. 4,493,441 to Sedam, et al., issued Jan. 15, 1985, gravity-flow syrup packages are plugged into sockets in cabinet-mounted valve assemblies. Each of the cabinet-mounted valve assemblies includes a built-in syrup valve with associated, interchangeable flow rate control orifice plates in syrup tubes thereof. A valve assembly of this general type with interchangeable orifice plates is disclosed in U.S. Pat. No. 4,376,496 to Sedam, et al., issued Mar. 15, 1983 and assigned to the same assignee as the present invention. In the dispenser of U.S. Pat. No. 4,493,441, there are three cabinet-mounted valve assemblies and each of these assemblies is preadjusted to achieve proper syrup flow rates with respect to the associated soda flow rate of that valve assembly for making a post-mix, carbonated beverage. This adjustment of flow rates of the syrup is achieved utilizing orifice plates with selected orifice sizes depending on the desired flavor of beverage concentrate or syrup to be dispensed by a particular valve assembly. In order to change flavors or brix valves of syrups for any selected valve assembly requires readjustment of that valve assembly, including the insertion of an appropriate orifice plate. This is not only a time-consuming procedure, but requires some special expertise on the part of the operator making the adjustment. Furthermore, unless such an adjustment is made, the number of flavors or beverages available from the dispenser is limited to the number of cabinet-mounted valve assemblies provided, which in the case of the aforementioned system of U.S. Pat. No. 4,493,441, is three flavors or beverages.

SUMMARY OF THE PRESENT INVENTION

Accordingly, it is a primary object of the present invention to provide a system which automatically changes orifice plates for each respective cabinet-mounted valve assembly as syrup containers with different flavors are substituted without requiring a special adjustment procedure of the syrup flow rates by a skilled operator.

It is further object of the present invention to provide a small-capacity beverage dispenser for use in small business establishments or in the home, offering a wide range of beverage flavors which exceed the number of cabinet-mounting dispenser valve assemblies provided without making any special adjustments to the cabinet-mounted assemblies.

It is another object of the present invention to provide a unique valve actuation assembly for simultaneously actuating a syrup valve which is attached to a syrup container and an associated soda valve contained within a cabinet-mounted valve assembly.

It is yet another object of the present invention to provide a valve actuator assembly for selectively dispensing either soda water alone or a combination of syrup and soda water as a post-mix beverage.

It is still another object of the present invention to provide a self-sealing syrup package which is readily removable from a beverage dispenser for storage in a refrigerator or the like until further use of that package is desired.

The objects of the present invention are fulfilled by providing a post-mix beverage dispenser system including a predetermined number of cabinet-mounted valve assemblies and associated dispensing nozzles rigidly affixed to a dispenser cabinet. Each of the valve assemblies includes a soda valve for controlling the flow of carbonated water to the nozzle, the improvement comprising a plurality of syrup valve adaptor assemblies of a number in excess of the predetermined number of cabinet-mounted valve assemblies, each of said syrup valve adaptor assemblies including a main housing having an open end removable connectable to a discharge spout of a gravity-flow syrup container, a normally closed syrup valve in the main housing for controlling the flow of syrup from the spout, a syrup outlet conduit connected to the syrup valve, and a flow-rate control orifice plate in the outlet conduit in fluid communication with the syrup valve having a predetermined orifice size compatible with the brix value of a predetermined flavor of syrup, the orifice size of each valve adaptor assembly being different to be compatible with different brix values of syrup; and a socket in each said cabinet-mounted valve assembly for removably receiving a selected one of the syrup valve adaptor assemblies to operatively position the syrup outlet conduit with respect to an associated dispensing nozzle.

The present invention also provides a valve actuation lever assembly for actuating the syrup and soda valves of the above-described post-mix beverage dispenser system. This lever assembly is capable of simultaneously actuating the soda valve of the cabinet-mounted valve assemblies and the syrup valve within the syrup valve adaptor assemblies. Furthermore, the valve actuation lever assembly of the present invention includes the capability of selectively actuating only the soda valve to dispense carbonated water alone or the syrup valve in combination with the soda valve to dispense a post-mix, carbonated beverage.

The present invention also provides a unique syrup package construction in alternative embodiments, including refillable syrup tanks in combination with normally-closed syrup valve assemblies operatively connected to the discharge spout of the syrup tank.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
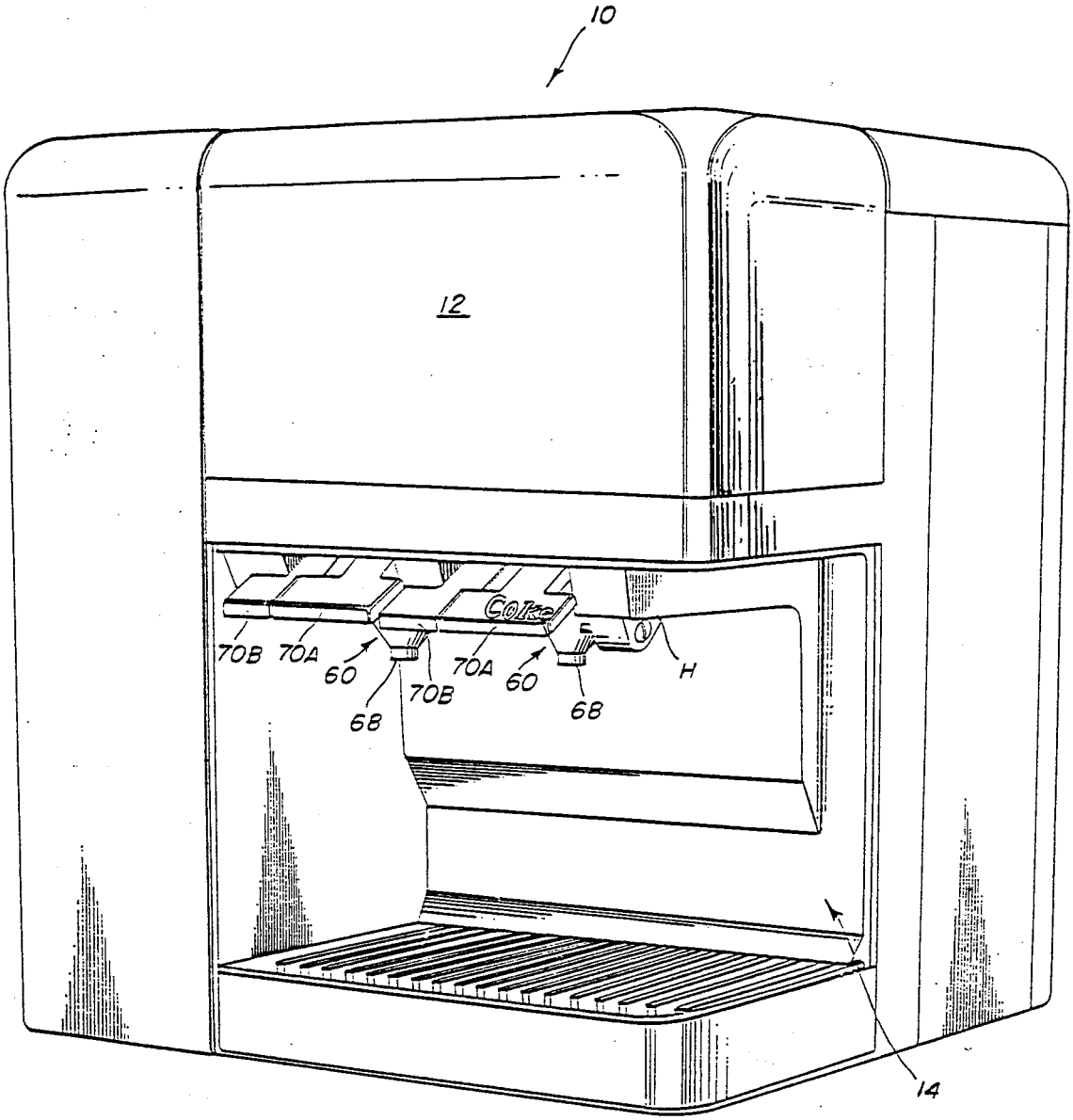
FIG. 1 is a right, front perspective view of a beverage dispenser cabinet construction suitable for use with the beverage dispensing system of the present invention.

A suitable cabinet structure for use in the post-mix beverage dispensing system of the present invention is illustrated in FIG. 1. The cabinet 10 includes a substantially rectangular-shaped housing fabricated from plastic material and suitable compartments to house sources of $CO_2$ and water to form carbonated water in a carbonator device, and a compartment 12 for housing suitable syrup supply containers. The dispenser cabinet illustrated in FIG. 1 includes two cabinet-mounted valve assemblies 60 connected to the frame of the cabinet within a recess 14 just below the syrup compartment 12. As will become more fully apparent hereinafter, these cabinet-mounted valve assemblies generally include dispensing nozzles 68 and valve actuator lever assemblies 70. The lever assemblies 70 are pivotally mounted in sidewalls H of the recess 14 of cabinet 10, as will become more readily apparent hereinafter with reference to FIGS. 4 and 5.

Figure 2:
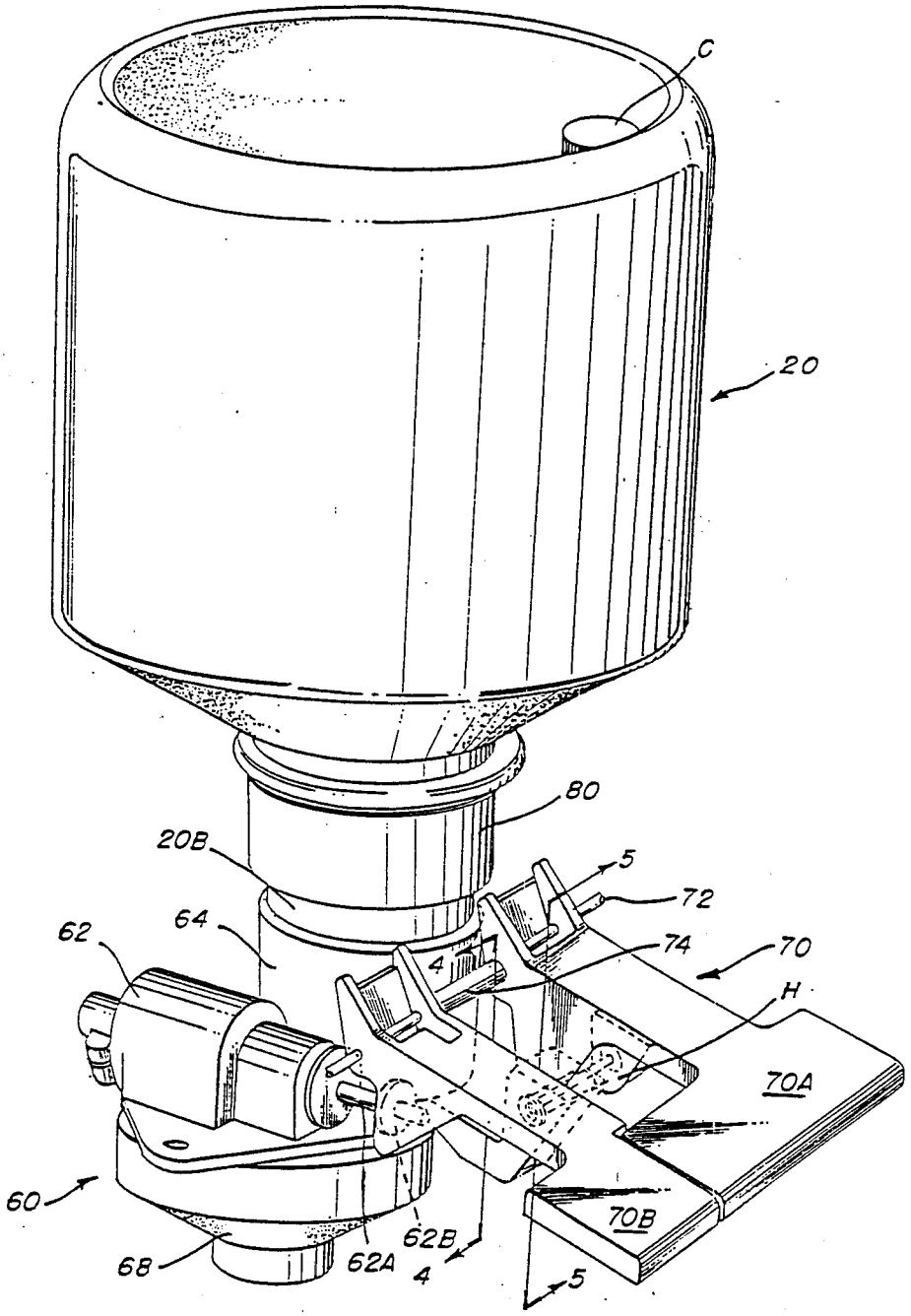
FIG. 2 is a perspective view of a single cabinet-mounted valve assembly of the two cabinet-mounted valve asemblies illustrated in FIG. 1 showing a gravity-flow syrup container operatively connected thereto and details of the valve actuating levers of the present invention.
Figure 3:
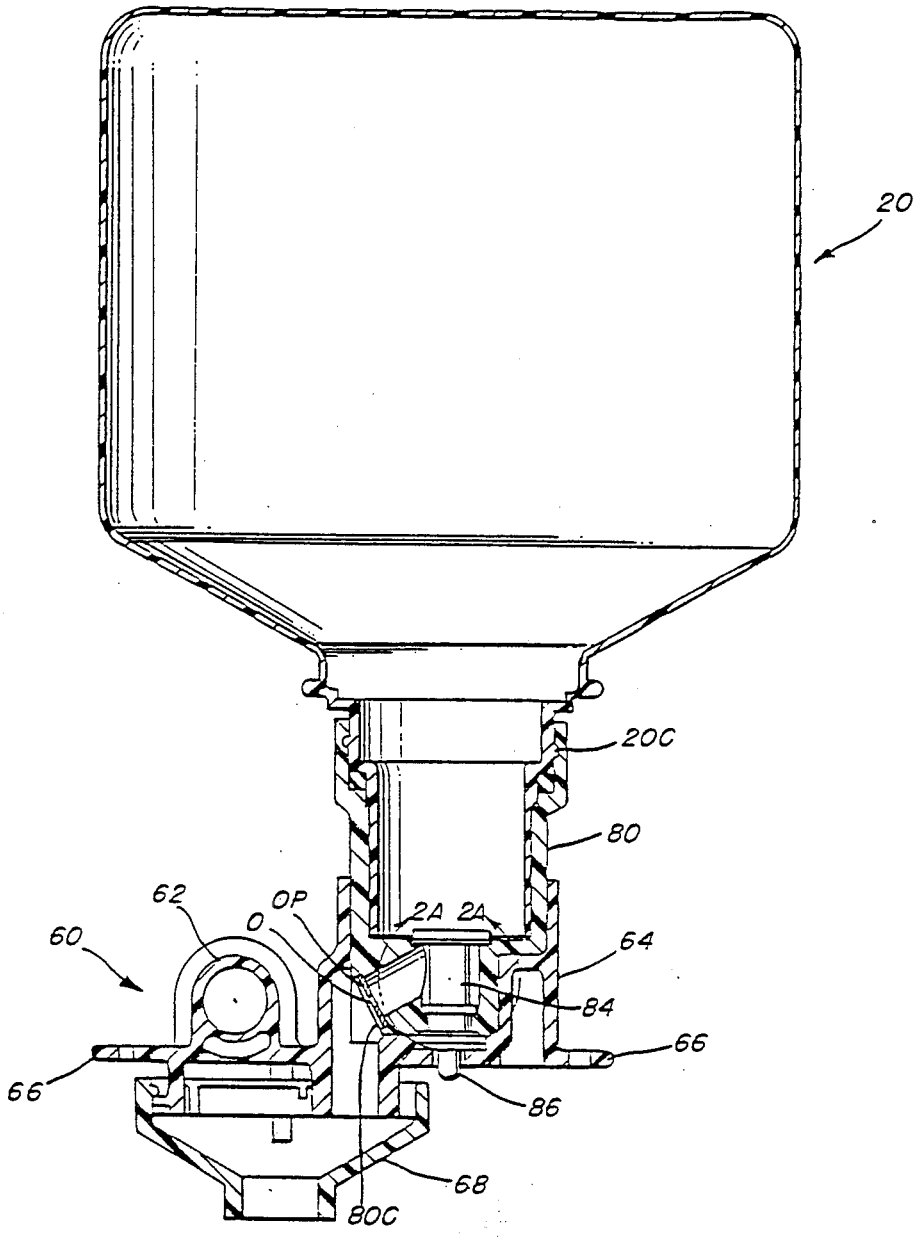
FIG. 3 is a sectional view in side elevation of a cabinet-mounted valve assembly with a syrup valve adaptor assembly inserted in a socket thereof and a syrup container connected to the adaptor.

The details of each of the cabinet-mounted valve assemblies 60 are illustrated in FIGS. 2 and 3. Valve assembly 60 includes a main body secured to the frame of the cabinet 10 at flanges 66 just below the syrup compartment 12. The assembly includes a removable dispensing nozzle portion 68 disposed just below a soda valve 62. Soda valve 62 has a horizontally-extending bore in which there is disposed an elastomeric poppet valve element, such as that disclosed in the valve of U.S. Pat. No. 4,376,496 to Sedam, et al., issued Mar. 15, 1983. A valve actuating pin 62A extends from the bore of the soda valve 62 and has an actuation disk 62B secured thereto which is operatively associated with a soda valve actuation lever 70B, to be described more fully hereinafter. The rear side of soda valve 62 as viewed in FIG. 2 is connected to a carbonated water supply line from the carbonator disposed within cabinet 10 (not shown). The cabinet-mounted valve assembly 60 further includes an upwardly-facing socket 64 offset from the nozzle 68 and soda valve 62. Upwardly-facing socket 64 receives and supports a syrup valve adaptor assembly 80 including a syrup valve poppet 84, syrup tube 80C, orifice plate OP and a syrup valve actuating pin 86 extending through an opening in the bottom of socket 64. Syrup valve actuating pin 86 extends to a position for operative connection to a syrup valve actuation lever 70A in a manner to be further described in connection with FIGS. 4 and 5.

Also illustrated in FIGS. 2 and 3 is a gravity-flow syrup package 20 having a removable cap C on a flow-rate control vent tube. This syrup container 20 is screwed into an opening in the upper end of adaptor 80 by screw threads 20C.

Figure 3A:
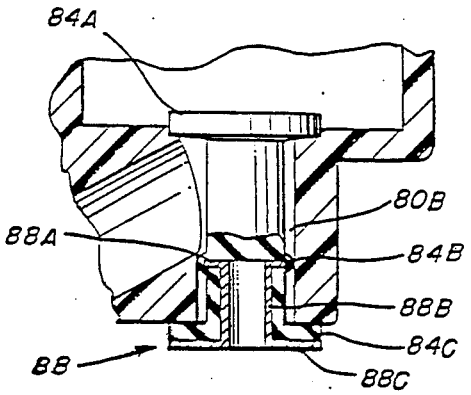
FIG. 3A is an enlarged sectional view taken along lines 3A—3A of FIG. 3.
Figure 6:
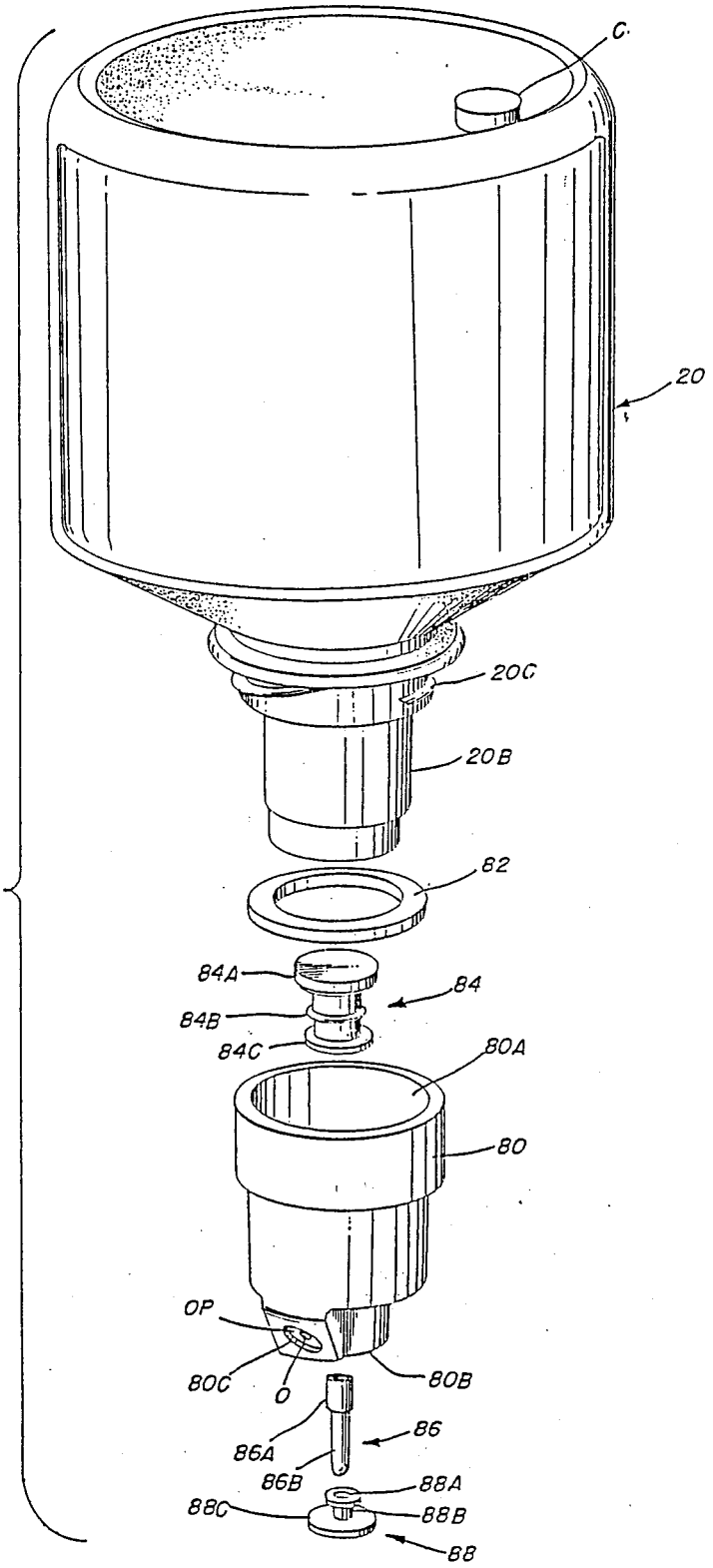
FIG. 6 is an exploded view illustrating the details of the syrup valve adaptor assembly of the present invention and the associated syrup valve therein and the manner in which it is removably connectable to a gravity-flow syrup container.

The exploded view of FIG. 6 illustrates more details of the syrup valve adaptor assembly 80 and the syrup valve therein. Adaptor 80 includes a main cylindrical body with an upper cylindrical opening 80A and a bottom cylindrical bore 80B for housing the syrup valve. The syrup valve includes an elastomeric poppet 84 having an upper sealing flange 84A, an intermediate sealing ring 84B and a bottom locking flange 84C. As illustrated in the enlarged sectional view of FIG. 3A, the poppet 84 is secured within the bore 80B by a bushing 88. Bushing 88 includes an upper disk portion 88A and a lower disk portion 88C connected by a stem portion 88B. A cylindrical bore passes all the way through the center of bushing 88 for receiving a syrup valve actuating pin 86. The upper disk 88A of bushing 88 is inserted within a central cylindrical bore of poppet 84 and presses against the inside walls of ring 84B to form a liquid-type seal at 84B within the bore 80B of housing 80. The bottom disk 88C of bushing 88 seats against the bottom disk 84C of poppet 84 to reinforce the same. The valve actuating pin 86 has an upper portion 86A which extends within poppet 84 and pushes on the inner surface of sealing disk 84A. The actuating pin portion 86B extends from the bottom of bore 80B to positions where it may be engaged by a valve actuation lever. To open the syrup valve, actuator pin 86 is forced upwardly in bore 80B to stretch elastomeric poppet 84 and sealing flange 84A thereof away from sealing engagement with the upper end of bore 80B. When this occurs, syrup is free to flow around sealing flange 84A into syrup conduit 80C, through the aperture O of orifice plate OP and into the upper end of the mixing nozzle 68 of the cabinet-mounted valve assembly.

In accordance with the present invention, a plurality of syrup valve adaptor assemblies 80 are provided, each of which has a different orifice plate OP therein to facilitate the dispensing of different flavors of syrup with different brix values. The diameter of the orifice O within each of these respective orifice plates differs and is matched to the brix values of the syrups to be dispensed. Preferably, the respective syrup valve adaptor assemblies will be color-coded or marked in any other suitable manner to designate the flavor of syrup and brix value for which it is to be used, to readily enable an unskilled operator to interchange syrup containers within the socket 64 of the cabinet valve assembly 60 illustrated in FIG. 1. This provides the system of the present invention with a much broader range of available syrup flavors for forming a variety of post-mix beverages than would be available in conventional systems not including the syrup valve adaptor assemblies of the present invention. For example, in a beverage dispenser having only two cabinet-mounted valve assemblies, if it were desired to dispense more than two types of post-mix beverages, it would be necessary to change orifice plates within the built-in syrup valve assemblies of those devices whenever a change in syrup flavors was desired. However, with the system of the present invention, this adjustment is automatically accomplished by simply changing syrup valve adaptor assemblies 80, which include orifice plates matched to different brix values. Therefore, although the system of the present invention as illustrated in FIG. 1 only has two cabinet-mounted valve assemblies, it could have a dozen distinct types of syrup valve adaptor assemblies for facilitating the dispensing of a dozen beverage flavors by simply attaching a selected one of the syrup valve adaptors 80 onto a syrup container 20 and inserting the adaptor into the socket 64 of the cabinet-mounted valve assembly 60. Therefore, a very small, low-cost beverage dispenser with a small number of cabinet-mounted valve assemblies may be utilized for dispensing a wide range of beverage flavors in the system of the present invention.

Figure 4:
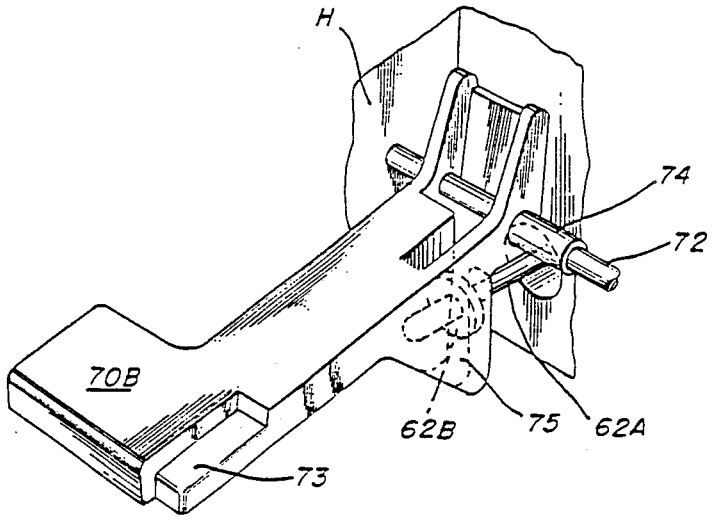
FIG. 4 is a perspective view looking in the direction of lines 4—4 of FIG. 2, illustrating details of the soda valve actuation lever of the present invention.
Figure 5:
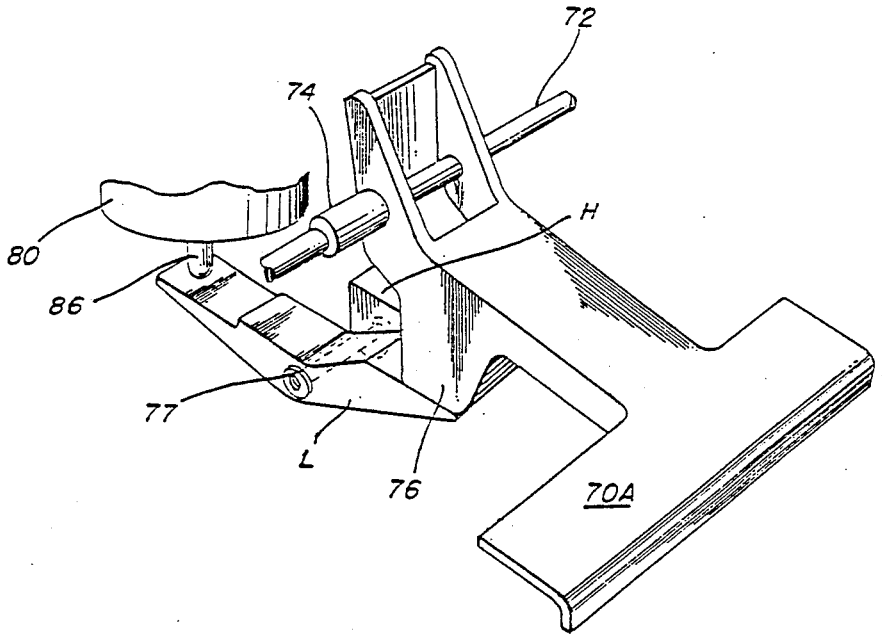
FIG. 5 is a perspective view looking along lines 5—5 of FIG. 2, illustrating a syrup valve actuation lever of the present invention.

The valve actuator lever assembly 70 of the present invention is illustrated in FIGS. 2, 4 and 5. The assembly 70 includes a split pair of levers 70A and 70B having enlarged, substantially coplanar actuation ends and pivot ends pivotally mounted on a pivot shaft 72, which is attached to the sidewalls H within the recess 14 of cabinet 10. Lever 70A is operatively connected to the valve actuation pin 86 of the syrup valve via a rocker lever L pivotally mounted around a pin 77, secured to a sidewall H of the cabinet 10 within recess 14. As illustrated in FIG. 5, rocker lever L has an outboard end which engages a lower protrusion on lever 70A and an inboard end which engages actuation pin 86 of the syrup valve. Accordingly, as the enlarged actuation end of lever 70A is depressed, protrusion 76 pushes on the outboard end of lever L which pivots the inboard end upwardly against pin 86 to open the syrup valve poppet 84. Also mounted on the same pivot shaft 72 with lever 70A, and spaced therefrom by a sleeve 74, is a lever 70B for actuating the soda valve 62. Lever 70B, as best illustrated in FIG. 4, has a downwardly-extending, bifurcated protrusion on the bottom thereof defining a slot 75 through which actuation pin 62A of soda valve 62 extends. The actuation disk 62B of soda valve 62 is pushed by the bifurcated projection as lever 70B is pivoted about pivot shaft 72, to depress actuation pin 62A and open the elastomeric poppet of the soda valve 62, to permit the flow of carbonated water into the dispensing nozzle 68.

In order to facilitate the dispensing of soda water alone, lever 70B is independently operable with respect to lever 70A. However, the converse is not true. Lever 70B has a cut-out portion 73 which is conformally shaped with respect to the concave underside of syrup actuation lever 70A and underlies a portion of lever 70A in the direction of actuation of the levers. Accordingly, when lever 70A is depressed, it pushes against cut-out portion 73 of lever 70B and also actuates the soda valve 62. Therefore, in order to dispense a post-mix beverage, one may simply depress lever 70A, which in turn depresses lever 70B, and the syrup and soda valves are simultaneously actuated to permit the flow of the proper ratio of syrup and carbonated water into mixing nozzle 68. On the other hand, if one wishes to merely dispense a cup of soda water, lever 70B can be actuated independently of the operation of lever 70A.

The syrup containers 20 for use with the present invention are of the gravity-flow type, preferably with flow-rate control tubes therein and may be of the form disclosed in U.S. Pat. No. 4,216,885 to Sedam, issued Aug. 12, 1980 and U.S. Pat. No. Des. 273,768 to Sedam, et al., issued May 8, 1984. The syrup containers in the aforementioned Sedam Patents are both sealed containers and are disposable. Any suitable size syrup container may be utilized, but it is contemplated that the containers to be used in the system of the present invention may be small containers of approximately 1 liter in volume.

Figure 8:
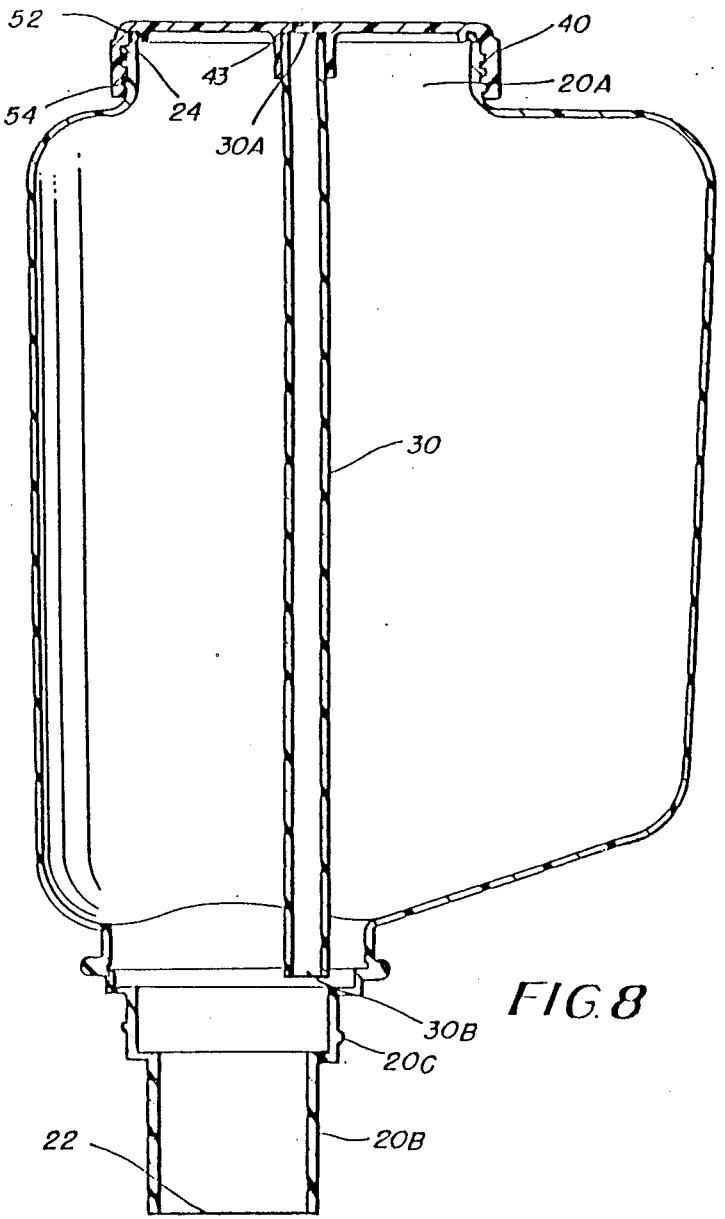
FIGS. 7 and 8 are alternative embodiments of syrup tanks suitable for use with the present invention, which may be refillable through removable lids and which may have the syrup valve adaptor assemblies of the present invention removably secured to the discharge spouts thereof.
Figure 7:
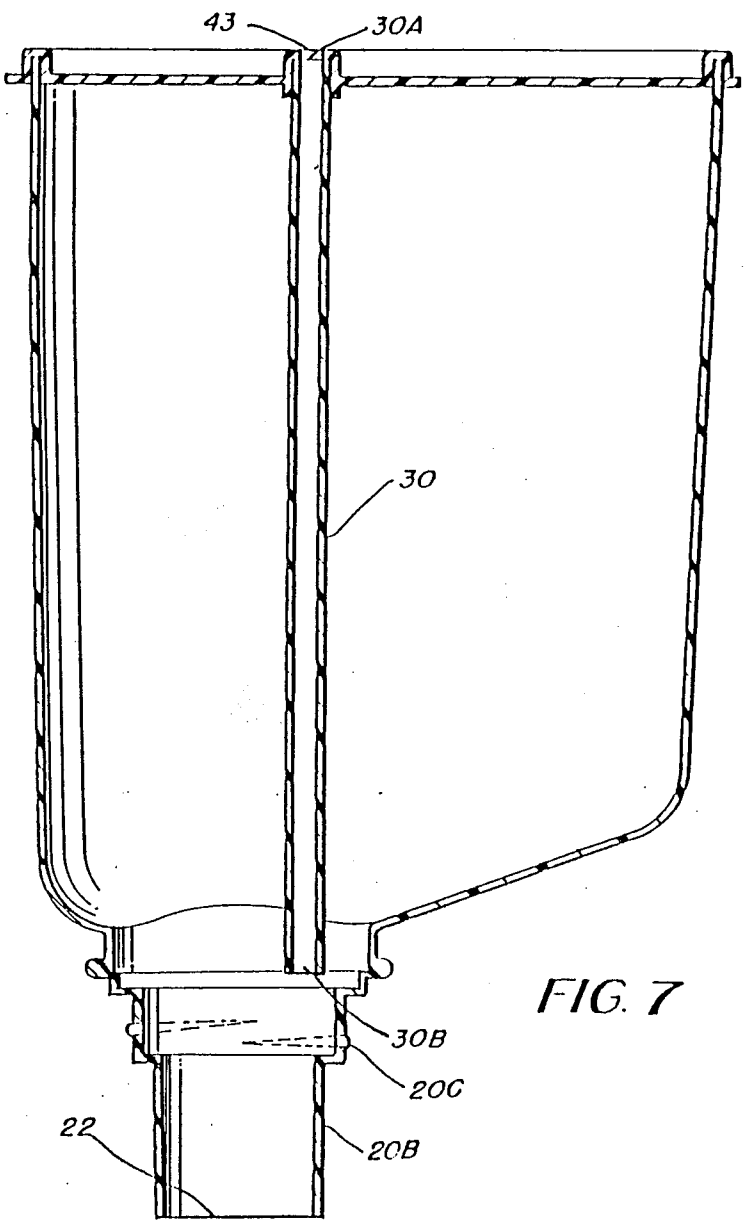

As an alternative to disposable containers, the syrup containers 20 of the present invention may be refillable syrup tanks of the type illustrated in FIGS. 7 and 8.

Referring to FIGS. 7 and 8, there is generally indicated a syrup tank 20 which may be plastic, metal or any other liquid-impervious material having an open top end 20A and an open bottom end 20B with a discharge spout 20S therein defining a discharge opening 22. Disposed within the syrup tank 20 is a flow rate control tube 30 having an open end 30A and an open bottom end 30B.

Open end 30A of tube 30 is supported within a socket 42 in a removable lid 40. The end 30A of tube 30 is preferably permanently secured in socket 42 by heat sealing, ultrasonic welding, or by the use of suitable adhesives. Socket 42 has an aperture 43 which communicates with the atmosphere and the open end of the tube 30A.

Removable lid 40 in the embodiment of FIG. 7 is provided with a peripheral shoulder 44 and a slot 46 which snap-fits over the peripheral rim 24 of the tank's open end 20A. Lid 40 is injection molded from a flexible plastic material, and the width of groove 46 therein is slightly less than the thickness of rim 24 to provide a snug, snap-fitting relationship. This assures the provision of a hermetic seal about rim 24 so that atmospheric pressure may be introduced into tank 20 only via aperture 43 and tube 30. Lid 40 also has a protrusion 48 extending from shoulder 44 to be gripped by an operator's fingers for removing the lid from tank 20, when the tank is to be refilled with syrup.

In the embodiment of FIG. 8, removable lid 40 is threaded as at 54, so that it may be screwed to a reduced diameter portion of tank 20 defining open top end 20A. A hermatic seal is provided in this embodiment by an O-ring 52 disposed in a peripheral groove 50 within removable lid 40. When screwed in place as shown in FIG. 4, O-ring 52 is compressed between rim 24 and lid 40, providing the desired hermetic seal.

Regardless of what type of syrup container is utilized, namely disposable or refillable containers, in accordance with the present invention the discharge spout 20B thereof is provided with screw threads 20C to enable the syrup valve adaptor assembly 80 to be attached thereto by screwing. A seal or gasket 82 is provided around spout 20B to preclude leakage during handling and storage of containers.

What is claimed is:

1. A valve assembly for selectively dispensing a carbonated post-mix beverage or carbonated water alone from a post-mix beverage dispenser comprising:

(a) a syrup valve connected to a syrup supply;

(b) a soda valve connected to a source of carbonated water; and (c) valve actuator means including a first lever for opening said soda valve and a second lever for opening said syrup valve, said first and second levers having pivot ends mounted on a pivot shaft and manually engageable actuation ends, said actuation ends being disposed in substantially the same plane, a portion of the actuation end of said first lever underlying a portion of the actuation end of the second lever in the direction of actuation, said second lever also having a protrusion in between said actuation end and said pivot end, said valve actuator means further comprising a rocker layer mounted about a second pivot shaft for operatively engaging the protrusion of said second lever, wherein said second pivot shaft lies below and substantially parallel to said first pivot shaft, whereby upon depression of said second lever the protrusion causes said rocker lever to pivot about said second pivot shaft and open said syrup valve causing syrup to be dispensed for mixing a post-mixed beverage;

whereby said first lever may be actuated independently of said second lever to open said soda valve, but actuation of said second lever also actuates said first lever, causing both said syrup and soda valves to open.

* * * * *